United States Patent [19]

Mitchell et al.

[11] 3,980,132

[45] Sept. 14, 1976

[54] HEAT EXCHANGER WITH SELF-ADJUSTING SNAP-ON FAN SHROUD

[75] Inventors: Thomas L. Mitchell, Washington; Ronald C. Stump, Peoria, both of Ill.

[73] Assignee: Caterpillar Tractor Co., Peoria, Ill.

[22] Filed: Oct. 16, 1975

[21] Appl. No.: 623,131

[52] U.S. Cl. ..... 165/76; 180/68 R; 165/122

[51] Int. Cl.[2] ..... F28F 7/00

[58] Field of Search ..... 165/122, 76, 134; 98/40 B; 415/121 G; 180/68 R, 68 P, 54 A, 54 D; 123/41.48; 220/346

[56] References Cited

UNITED STATES PATENTS

| | | | |
|---|---|---|---|
| 2,966,339 | 12/1960 | Morgan | 123/41.48 |
| 3,612,173 | 10/1971 | Goyal | 165/122 |
| 3,788,419 | 1/1974 | Drone et al. | 180/68 R |
| 3,937,189 | 2/1976 | Beck | 165/122 |

FOREIGN PATENTS OR APPLICATIONS

| | | | |
|---|---|---|---|
| 568,471 | 10/1957 | Italy | 220/346 |
| 953,197 | 3/1964 | United Kingdom | 415/121 G |

*Primary Examiner*—Charles J. Myhre
*Assistant Examiner*—Theophil W. Streule, Jr.
*Attorney, Agent, or Firm*—Wegner, Stellman, McCord, Wiles & Wood

[57] ABSTRACT

Heat exchanger having a self-adjusting snap-on fan shroud. The shroud defines a one-piece element having integral mounting structure for snap-on mounting to the heat exchanger and biasing structure for urging the shroud to a preselected centered position relative to the fan. The shroud may be formed of molded synthetic resin. The heat exchanger may be provided with securing bolts with the shroud mounting structure being adapted to loosely embrace the bolts in the snapped-on arrangement of the shroud.

12 Claims, 4 Drawing Figures

Fig. 1
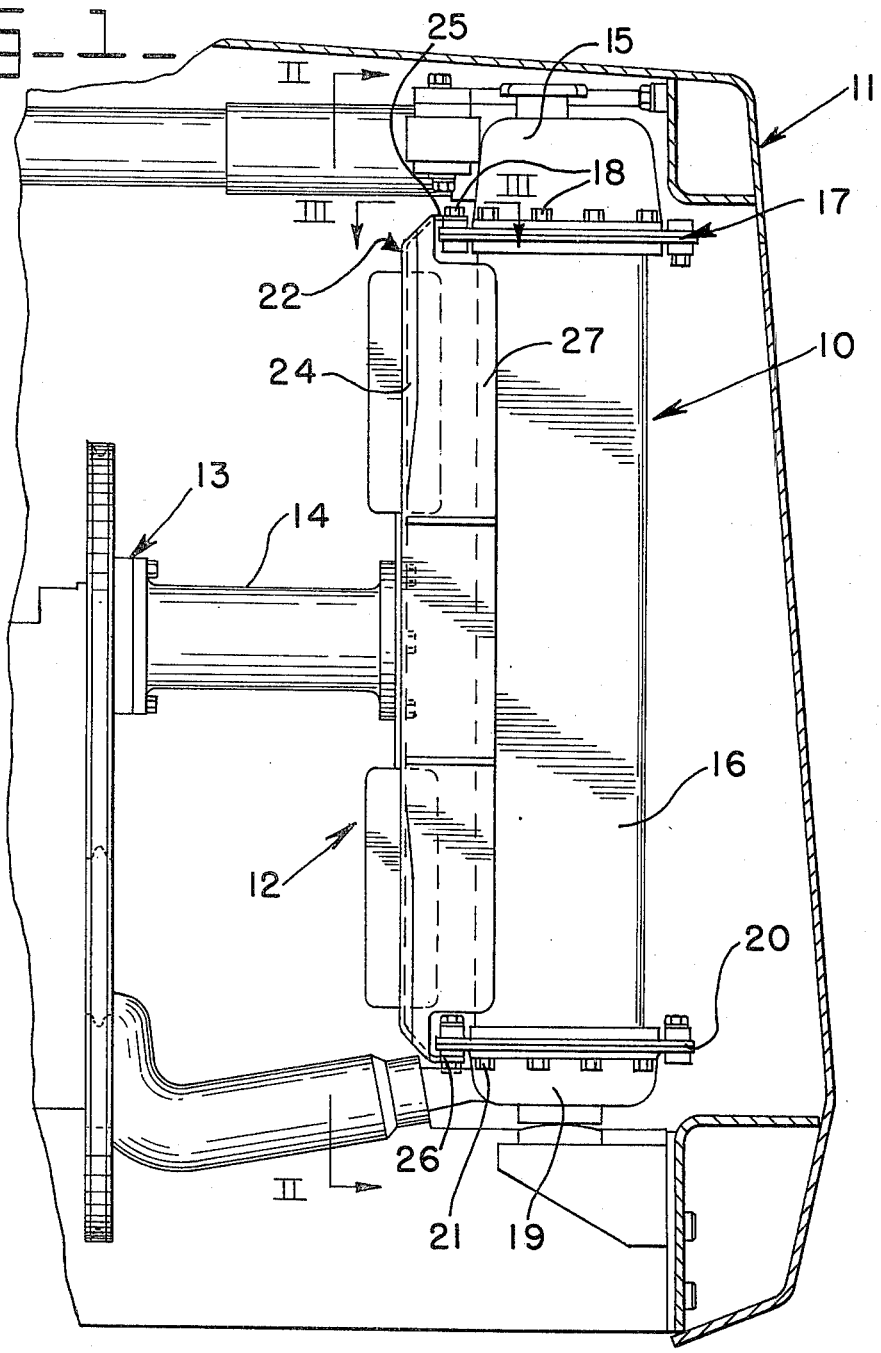
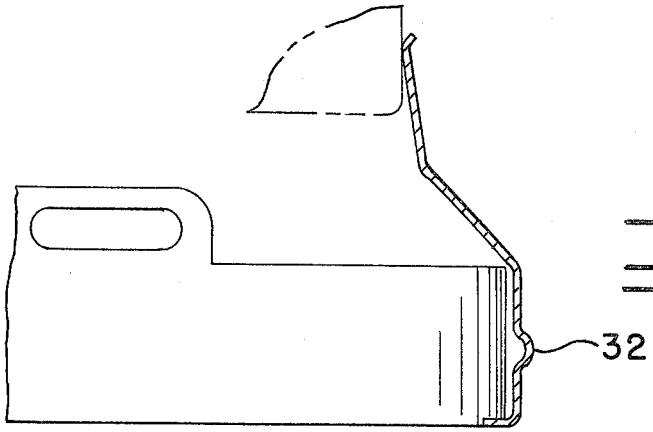
Fig. 4

HEAT EXCHANGER WITH SELF-ADJUSTING SNAP-ON FAN SHROUD

BACKGROUND OF THE INVENTION

1. Field of the Invention

This invention relates to heat exchangers and in particular to means for mounting a fan shroud in association with a heat exchanger fan.

2. Description of the Prior Art

In the heat exchanger apparatuses, such as vehicle radiators, it has been conventional to provide a fabricated sheet metal shroud in association with the radiator fan. The sheet metal shroud conventionally has utilized approximately 100 different parts and has resultingly been expensive and complicated.

Further, in rigorous environment installations of such shrouds, such as on tractors and the like, the means for securing the various piece parts of the prior art shrouds must be relatively strong and, thus, expensive and weighty, thereby presenting a further disadvantage in the use thereof.

SUMMARY OF THE INVENTION

The present invention comprehends an improved heat transfer apparatus wherein the shroud is provided with integral mounting means to define a one-piece shroud element serving as a direct replacement for the prior art shroud structures utilizing upwardly of 100 piece parts.

The invention further comprehends providing integrally with the shroud, biasing means for urging the shroud to a preselected centered position relative to the fan when installed on the heat exchanger.

In the illustrated embodiment, the heat exchanger defines a plurality of outwardly extending bolts and the mounting means comprises means for loosely embracing the bolts.

More specifically, the mounting means may embrace the bolts at the top of the heat exchanger which illustratively may comprise a radiator. Additionally, the mounting means may embrace the bolts at the bottom of the radiator. The mounting means may define horizontally extending walls which respectively overlie and underlie top and bottom portions of the radiator and may be provided with laterally extending slots for loosely receiving the bolts in the desired embracing relationship.

The biasing means may be defined by the top and bottom horizontally projecting walls which may have a preselected resiliency to effect the desired self-centering of the shroud in a vertical direction. The biasing means may include vertical walls at the opposite sides of the shroud for engaging the sides of the radiator to horizontally center the shroud.

In the illustrated embodiment, the shroud is formed of a fiber reinforced molded synthetic resin to define a one-piece low cost self-centering snap-on shroud means.

Thus, the shroud means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary side elevation of a portion of a tractor having a radiator heat exchanger, a cooling fan, and a shroud means embodying the invention;

FIG. 4 is a fragmentary enlarged horizontal section taken substantially along the line IV—IV of FIG. 2.

DESCRIPTION OF THE PREFERRED EMBODIMENT

Figure 2:
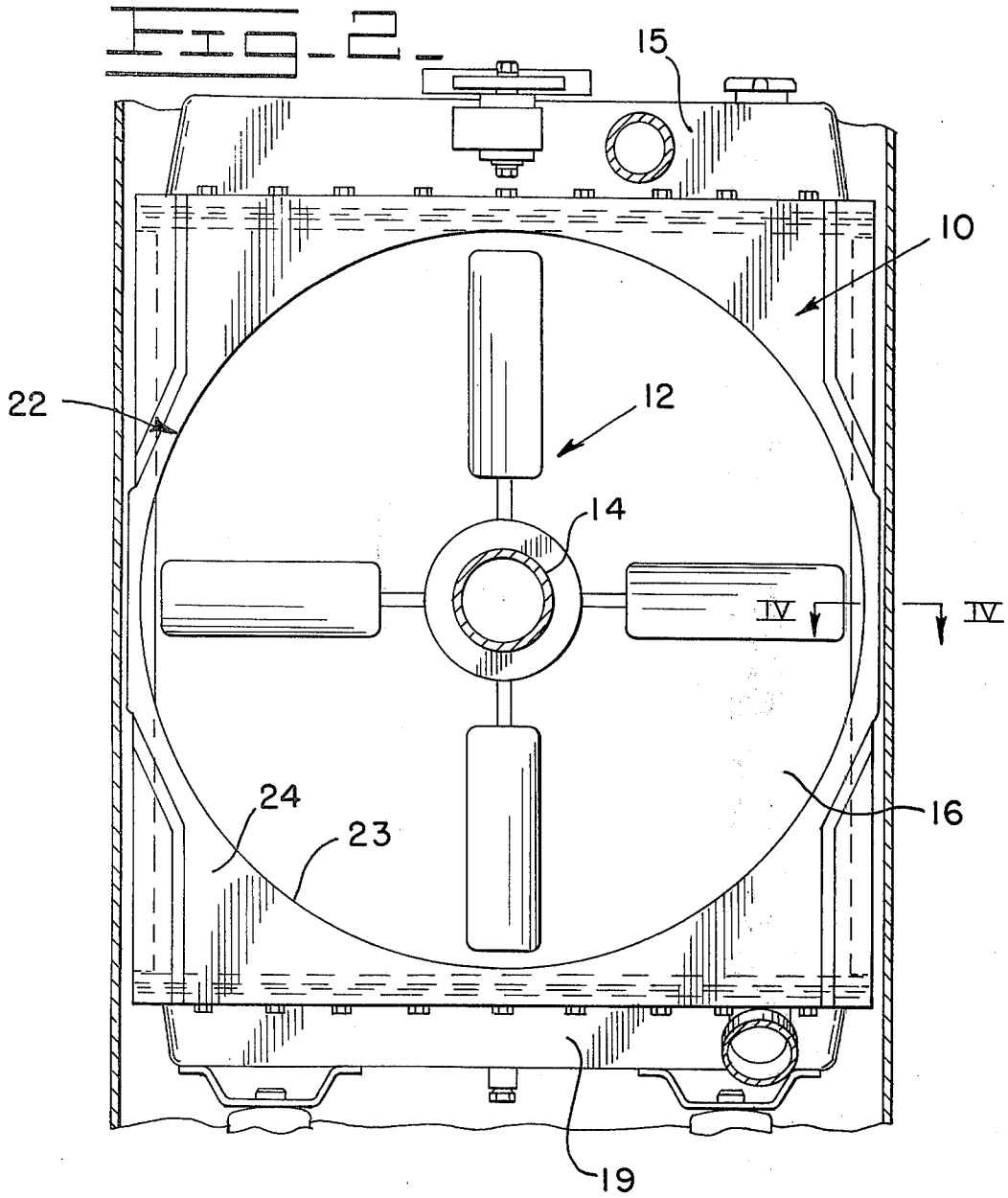
FIG. 2 is a vertical section taken substantially along the line II—II of FIG. 1.

In the exemplary embodiment of the invention as disclosed in the drawing, a heat exchanger generally designated 10 is shown to comprise a radiator for use in a vehicle, such as a tractor, generally designated 11. A fan generally designated 12 is provided rearwardly of the radiator for drawing air through the radiator to cool engine cooling fluid passed through the radiator in heat exchange relationship with the flowed air. The fan may be driven from the engine 13 of the tractor by means of a shaft 14 in the normal manner.

The radiator may include a top tank 15 bolted to the radiator core portion 16 by means of flanges 17 and a plurality of bolts 18. The radiator further includes a bottom tank 19 which may be secured to the core 16 by means of flanges 20 and a plurality of bottom bolts 21.

The fan may be partially enclosed by a shroud generally designated 22 having a circular opening 23 for passing air through the radiator core 16 and fan 12, as best illustrated in FIG. 2.

The present invention comprehends an improved arrangement of shroud 22 which provides a self-centering snap-on mounting of the shroud on the radiator. More specifically, the shroud includes a face portion 24 defining the central opening 23. At the top of the face portion, the shroud is provided with an integral rearwardly projecting top wall 25 and at the bottom, the shroud is provided with an integral rearwardly projecting bottom wall 26. At the opposite sides of the shroud face portion, the shroud is provided with integral vertically extending sidewall portions 27 and 28.

Figure 3:
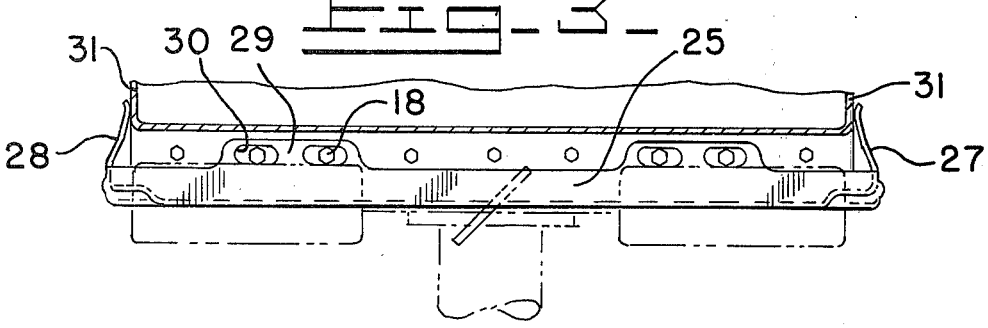
FIG. 3 is a fragmentary horizontal section taken substantially along the line III—III of FIG. 1.

As shown in FIGS. 1 and 3, the top wall 25 and bottom wall 26 define rearwardly projecting portions 29 having laterally elongated slots 30 embracing the bolts 18 and 21. Wall 25 closely overlies the flanges 17 and wall 26 closely underlies flanges 20 whereby the walls may be snapped over the bolts 18 and 21 to effectively define a vertically straddling mount of the shroud to the radiator.

The sidewall portions 27 and 28, as seen in FIG. 3, resiliently engage the sidewalls 31 of the radiator to bias the shroud horizontally to a centered position relative to the fan, as seen in FIG. 2. The side walls 27 and 28 may include vertical ribs 32 for strengthening of the shroud in a vertical direction while permitting resilient flexing of the sidewall portions 27 and 28 in the centering action.

Top wall 25 and bottom wall 26 similarly define resilient walls permitting limited displacement of the shroud vertically while effecting a self-centering action by the straddling arrangement thereof about the radiator to the vertically centered position of FIG. 2.

The shroud may be formed as a one-piece molded synthetic resin element with the walls 25, 26, 27, and 28 formed integrally therewith to define a low cost self-adjusting snap-on shroud structure. In the illustrated embodiment, the shroud is formed of fiberglass reinforced polyester resin.

As shown in FIGS. 1 and 3, the top and bottom walls may include portions 29 for embracing less than all of the bolts disposed at spaced intervals along the rear of the top and bottom tanks 15 and 19, as desired.

Installation of the shroud is extremely simple as it requires only the snap-on mounting of the wall means about the rear portion of the radiator to provide an automatic self-centered arrangement of the shroud relative to the fan. Similarly, removal of the shroud may be readily effected by urging the resilient top wall upwardly to clear the top bolts 18 and withdrawal of the shroud wall elements from the straddling relationship thereof with the radiator.

The foregoing disclosure of specific embodiments is illustrative of the broad inventive concepts comprehended by the invention.

We claim:

1. In a heat transfer apparatus having a heat exchanger having air passages therethrough, a fan mounted adjacent said heat exchanger to cause air flow through said passages, and a fan shroud partially surrounding said fan for guiding the air flow through the fan, the improvement comprising:

mounting means integral with the shroud for mounting the shroud adjustably on the heat exchanger; and biasing means integral with the shroud for urging the shroud to a preselected centered position relative to the fan.

2. The heat exchange apparatus of claim 1 wherein said heat exchanger defines a plurality of upwardly projecting top portions and said mounting means comprises means loosely embracing said top portion.

3. The heat exchange apparatus of claim 1 wherein said heat exchanger defines a plurality of downwardly extending bottom portions and said mounting means includes means loosely embracing said bottom portions.

4. The heat exchange apparatus of claim 1 wherein said heat exchanger defines a plurality of upwardly projecting top portions and a plurality of downwardly projecting bottom portions, and said mounting means comprises wall means projecting horizontally from the shroud and defining openings loosely receiving said top and bottom portions.

5. The heat exchange apparatus of claim 1 wherein said heat exchanger defines a plurality of upwardly projecting top portions and a plurality of downwardly projecting bottom portions, and said mounting means comprises wall means projecting horizontally from the shroud and defining openings loosely receiving said top and bottom portions, said wall means including a top wall means closely overlying an upper portion of said heat exchanger and a bottom wall means closely underlying a lower wall portion of said heat exchanger.

6. The heat exchange apparatus of claim 1 wherein said mounting means and biasing means are formed unitarily with said shroud.

7. The heat exchange apparatus of claim 1 wherein said mounting means and biasing means are formed unitarily with said shroud of molded synthetic resin.

8. The heat exchange apparatus of claim 1 wherein said mounting means and biasing means are formed unitarily with said shroud of fiber reinforced molded synthetic resin.

9. The heat exchange apparatus of claim 1 wherein said heat exchanger defines a plurality of upwardly projecting top portions and a plurality of downwardly projecting bottom portions, and said mounting means comprises wall means projecting horizontally from the shroud and defining laterally elongated slots loosely receiving said top and bottom portions.

10. The heat exchange apparatus of claim 1 wherein said biasing means includes resilient wall means on the shroud straddling opposite sides of said heat exchanger for horizontally centering the shroud.

11. The heat exchange apparatus of claim 1 wherein said biasing means includes wall means on the shroud straddling the top and bottom of said heat exchanger for vertically centering the shroud.

12. The heat exchange apparatus of claim 1 wherein said heat exchanger includes a plurality of outwardly projecting bolts and said mounting means comprises means loosely embracing said bolts.

* * * * *